US005269507A

United States Patent [19]

Yoshida

[11] Patent Number: 5,269,507

[45] Date of Patent: Dec. 14, 1993

[54] PAPER DISJOINTING DEVICE FOR A PAPER FEEDING UNIT

[75] Inventor: Atsushi Yoshida, Hiroshima, Japan

[73] Assignee: Fuji Xerox Co., Ltd., Tokyo, Japan

[21] Appl. No.: 909,395

[22] Filed: Jul. 8, 1992

[30] Foreign Application Priority Data

Jul. 9, 1991 [JP] Japan ..... 3-194884

[51] Int. Cl.[5] ..... B65H 3/54

[52] U.S. Cl. ..... 271/170; 271/171

[58] Field of Search ..... 271/169, 170, 167, 171

[56] References Cited

FOREIGN PATENT DOCUMENTS

| | | | |
|---|---|---|---|
| 0251819 | 1/1988 | European Pat. Off. | 271/169 |
| 58-131234 | 9/1958 | Japan . | |
| 63-65631 | 10/1986 | Japan . | |
| 62-175330 | 8/1987 | Japan . | |
| 0191334 | 8/1987 | Japan | 271/170 |

*Primary Examiner*—H. Grant Skaggs
*Attorney, Agent, or Firm*—Finnegan, Henderson, Farabow, Garrett & Dunner

[57] ABSTRACT

A paper disjointing device employable for a paper feeding unit such as a paper feeding cassette or the like serves to individually disjoint papers from each other without an occurrence of malfunction that one corner of each paper is delivered ahead of the other corner of the same. To cope of a size of each paper to be delivered, papers received in the paper feeding unit are normally squeezed toward one side wall of the paper feeding unit by a movable side guide slidably mounted on a bottom plate of the paper feeding unit. The paper disjointing device includes a first snubber on the movable side and a second snubber on the stationary side. The first snubber is turnably mounted on the movable side guide so as to depress one corner of each paper, and has a comparatively light weight. The first snubber is normally turnably biased to generate a depressing force via a pawl member disposed at the foremost end thereof. The second snubber is turnably mounted on the side wall of the paper feeding unit so as to depress the other corner of the paper, and has a weight larger than that of the first snubber. The second snubber is likewise normally turnably biased to generate a depressing force via a pawl member disposed at the foremost end thereof. To assure that both the corners of each paper are depressed with a same depressing force, a coil spring is disposed at the rear end of the first snubber.

4 Claims, 2 Drawing Sheets

PAPER DISJOINTING DEVICE FOR A PAPER FEEDING UNIT

BACKGROUND OF THE INVENTION

1. Field of the Invention

The present invention relates generally to a snubber employable for a paper feeding unit such as a paper feeding cassette or the like to constitute a paper disjointing mechanism. More particularly, the present invention relates to a paper disjointing device for a paper feeding unit such as a paper feeding cassette or the like which is constructed such that a snubber on the movable side arranged for a movable side guide can generate a depressing force having the same value as that of a snubber on the stationary side.

2. Description of the Related Art

An electronic copying unit, a paper feeding cassette, or a similar unit is equipped with paper receiving means such as a paper feeding tray, a paper feeding cassette, or the like in a paper feeding section so as to deliver paper by actuating paper feeding means. The feeding means includes such elements as a paper feeding roller or the like arranged for the paper receiving means. Among the foregoing type of paper receiving means, a paper feeding tray or the like having a capability of receiving a number of papers is equipped merely with a mechanism for upwardly squeezing each paper toward the paper feeding roller. Paper disjointing means is arranged downstream of the paper feeding roller as disclosed in, e.g., an official gazette of Japanese Unexamined Patent Publication (KoKai) No. 62-175330. As a paper is delivered from the paper feeding tray by rotating the paper feeding roller, it is disjointed from a paper located below the first-mentioned paper with the aid of a paper disjointing mechanism so as to allow paper to be delivered to an image transferring section one by one.

In contrast with the aforementioned paper receiving means, another paper receiving means such as a paper feeding cassette or the like having a capability of receiving a comparatively small number of papers is constructed such that snubbers are arranged at corners on the opposite sides as seen in the paper delivering direction for papers received in the paper feeding tray so as to allow each snubber to perform a paper disjointing operation for the respective papers. A paper feeding cassette constructed as disclosed in, e.g., an official gazette of Japanese Unexamined Utility Model Publication (KoKai) No. 58-131234 can be noted as a paper feeding cassette of the last-mentioned type. With respect to the conventional paper feeding cassette including snubbers on the opposite side as seen in the paper delivering direction, a snubber on the reference line side is arranged at a stationary position, and the other snubber is arranged on a side guide. The snubber arranged on the side guide is displaced corresponding to a size of each paper to be used so that corner portions of the snubber on the opposite sides as seen in the paper discharging direction are held in the engaged state together with the snubber on the stationary side.

With respect to the paper feeding cassette constructed in the above-described manner, a paper feeding roller is arranged at the substantially central part of the foremost end of the paper feeding cassette as seen in the paper delivering direction so as to constitute a paper feeding section. As each paper is fed by rotating the paper feeding roller, it is gradually bent, and thereafter, the snubbers serving to depress corners of the paper on the opposite sides are slightly raised up attributable to the toughness of the paper itself. Subsequently, since only the uppermost paper passes past the snubber, a paper feeding operation is performed for each paper to be delivered from the paper feeding cassette while receiving disjointing resistance caused by the snubbers.

In many cases, the snubber arranged for the side guide in the paper feeding cassette is displaced with the aid of a guide cutout formed on the bottom plate of the paper feeding cassette until it is immovably kept at the position corresponding to the side edge of each paper. Because the snubber on the movable side is constructed in such a configuration as not to obstruct any turning movement of the bottom plate of the paper feeding cassette, there arises a necessity for forming a cutout which makes it possible for a part of the bottom plate to turn. Because of the foregoing necessity, the snubber on the movable side unavoidably constructed in such a state that a part of a plate constituting the snubber on the stationary side is cut out therefrom. For this reason, there arises a malfunction that both the snubbers are different from each other in weight.

In addition, in case that two snubbers for imparting a depressing function to corners of each paper on the opposite side as seen in the paper delivering direction exhibit a depressing power different from each other, there arises a problem that each paper is readily slantwise delivered from the paper feeding cassette. In other words, in case that a depressing power generated by each of the snubbers is different from each other, as a paper is delivered by the paper feeding roller, one of the corners of the paper depressed by the snubber having a light weight passes past the snubber ahead of the other corner, and thereafter, the other corner of the paper passes past the snubber having a heavy weight with delay. When papers are successively delivered from the paper feeding unit in the slantwise feeding state as mentioned above, an image fails to be built on each paper at a correct position. Thus, there arises another malfunction that all images are erroneously transferred to each paper, resulting in more work for an operator. Once a paper is slantwise delivered, a corner of the paper is engaged with another certain member in a paper transference passage extending from the paper feeding unit such as a paper feeding cassette or the like to the image transferring section, causing a paper feeding operation to be incorrectly performed. This results in increasing the workload of the operator because he must clear the paper transference passage that is jammed with the delivered paper.

SUMMARY OF THE INVENTION

The present invention has been made in consideration of the aforementioned problems to be solved.

An object of the present invention is to provide a paper disjointing device for a paper feeding unit such as a paper feeding cassette or the like wherein an occurrence of malfunction of slantwise paper feed can be prevented reliably.

Another object of the present invention is to provide a paper disjointing device for a paper feeding unit such as a paper feeding cassette or the like wherein a depressing force generated by a snubber on the movable side can substantially be equalized to a depressing force generated by a snubber on the stationary side.

According to the present invention, there is provided a paper disjointing device for a paper feeding unit such as a paper feeding cassette or the like wherein papers received in the paper feeding unit are normally squeezed against on a side wall of the paper feeding unit by a movable side guide slidably mounted on a bottom plate of the paper feeding unit so as to cope with a size of the papers, wherein the paper disjointing device comprises a first snubber turnably mounted on the movable side guide s as to depress one corner of each paper on the delivery side, the first snubber having a comparatively light weight and being normally turnably biased to generate a depressing force via a pawl member disposed at the foremost end thereof, and a second snubber turnably mounted on the side wall of the paper feeding unit located opposite to the movable side guide so as to depress the other corner of the paper, the second snubber having a weight larger than that of the first snubber and being normally turnably supported to generate a depressing force via a pawl member disposed at the foremost end thereof.

The depressing force of the first snubber is substantially equalized to the depressing force of the second snubber with the aid of biasing means effective for normally biasing the foremost end part of the first snubber.

It is preferable that the biasing means is a coil spring which is located behind a support shaft for the first snubber. In this case, it is recommendable that the coil spring is disposed between the rear end of the first snubber and a support anvil formed on the movable side guide.

Other objects, features and advantages of the present invention will readily become apparent from reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENT

Now, the present invention will be described in detail hereinafter with reference to the accompanying drawings which illustrate a paper disjointing device for a paper feeding unit such as a paper feeding cassette or the like in accordance with a preferred embodiment of the present invention.

Figure 1:
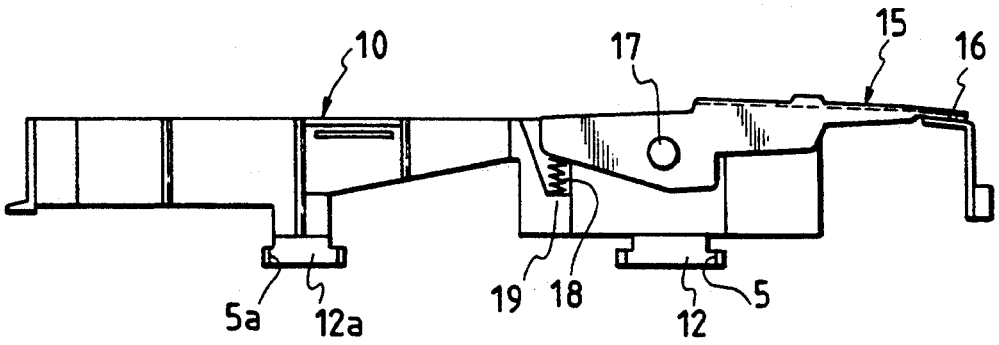
FIG. 1 is a fragmentary side view of a paper disjointing device for a paper feeding cassette in accordance with an embodiment of the present invention, particularly illustrating the structure of a movable side guide and a snubber on the movable side.
Figure 2:
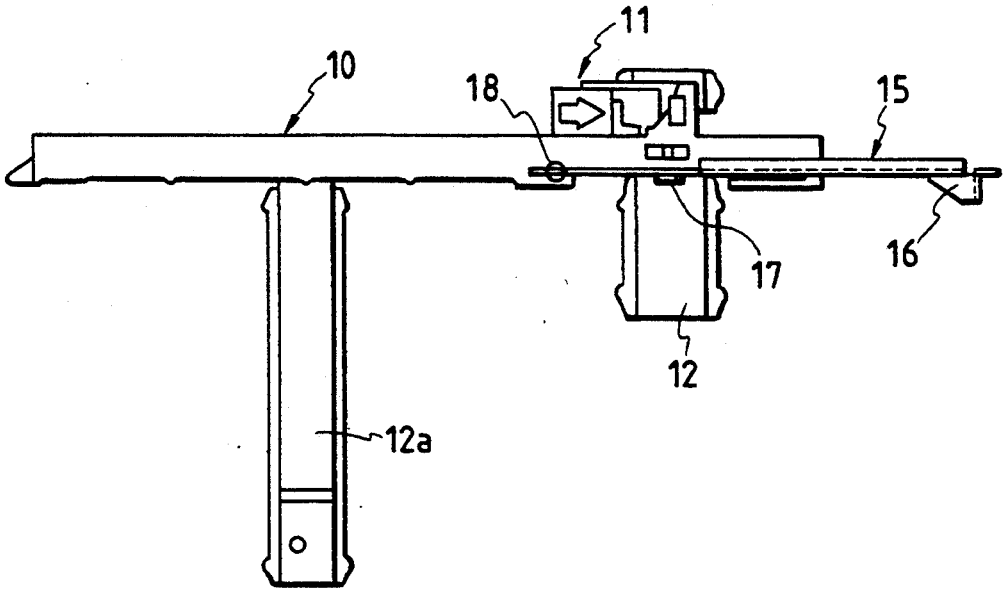
FIG. 2 is a plan view of the side guide and the snubber on the movable side guide shown in FIG. 1.

FIG. 1 is a side view of the paper disjointing device, particularly illustrating by way of example the structure of a movable side guide 10 for a paper feeding cassette 1, and FIG. 2 is a plan view of the same. As shown in FIG. 1 and FIG. 2, slidable movement of the side guide 10 relative to guide grooves 5 and 5a formed on the bottom plate of the paper feeding cassette 1 is properly guided with the aid of sliders 12 and 12a. The side guide 10 is constructed in the same manner as a conventional universal type paper feeding cassette such that it is located by squeezing papers received in the paper feeding cassette 1 along one side edge thereof. As is best seen in FIG. 2, a fixing member 11 is arranged for the side guide 10 so as to maintain the operative state that the one side edge of papers is properly located by the side guide 10. Incidentally, a fixing member having a mechanism as disclosed in, e.g., an official gazette of Japanese Unexamined Utility Model Publication (Kokai) No. 63-65631 or a similar member can be employed for the fixing member 11.

Figure 3:
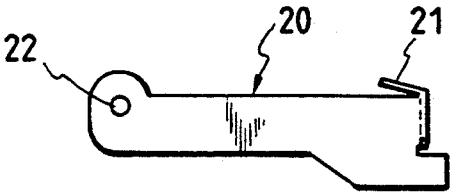
FIG. 3 is a side view of the snubber on the stationary side.

A snubber 15 on the movable side is arranged at the foremost end of the side guide 10 on the paper delivery side. Specifically, the snubber 15 is arranged on the paper depressing side of the side guide 10 so as to enable it to turn about a support shaft 17, and a corner of each paper is firmly held by a pawl member 16 disposed at the foremost end of the side guide 10. On the other hand, a snubber 20 on the stationary side is constructed such that a pawl member 21 is projected from the foremost end of a plate and a main body of the snubber 20 is turnably arranged to turn about a support shaft 22 as shown in FIG. 3. In contrast with the snubber 20 on the stationary side, the snubber 15 on the movable side is constructed such that a large cutout is formed behind the pawl member 16 so as to enable the bottom plate of the snubber 15 to turn in the space defined by the cutout. Thus, the snubber 15 is configured in the slender shape compared with the snubber 20, resulting in a weight of the snubber 15 being reduced substantially.

As shown in FIG. 1, the main part of a plate member for the snubber 20 is elongated beyond the support shaft 17 as seen from the right-hand side so that a spring 18 is disposed below the extension of the main part of the plate member. The spring 18 is located between a support anvil 19 projected sideward of the side guide 10 and the lower surface at the rear end of the snubber 15. Since it suffices that the spring 18 disposed for the snubber 15 generates a resilient force for depressing the pawl member 16 of the snubber 15 on each paper so as to be substantially equalized to the depressing force given by the snubber 20 on the stationary side, the spring 18 is designed in small dimensions and generates a weak resilient force. With such construction, the snubber 15 is normally biased by the spring 18 to turn about the support shaft 17 in the clockwise direction as seen in the drawing, whereby each paper is firmly held by the pawl member 16 at the one corner thereof.

As shown in FIG. 1 and FIG. 3, in case that the paper feeding cassette is constructed such that two kinds of snubbers, i.e., the snubber 20 on the stationary side and the snubber 15 on the movable side are arranged to come in engagement with each paper at both the corners, a magnitude of the depressing force given by the snubber 15 to be exerted on one corner of a paper delivered from the paper feeding cassette can substantially be equalized to that of the snubber 20 to be exerted on the other corner of the same. Once the depressing force of the snubber 15 is substantially equalized to the depressing force of the snubber 20, the frequency of oscillatory movement of the snubber 15 becomes coincident with that of the snubber 20 when each paper is delivered by rotating the paper feeding roller. Thus, there does not arise a malfunction that one corner of the paper moves ahead of the other corner of the same, resulting in an occurrence of malfunction of slantwise paper feed being reliably prevented.

Figure 4:
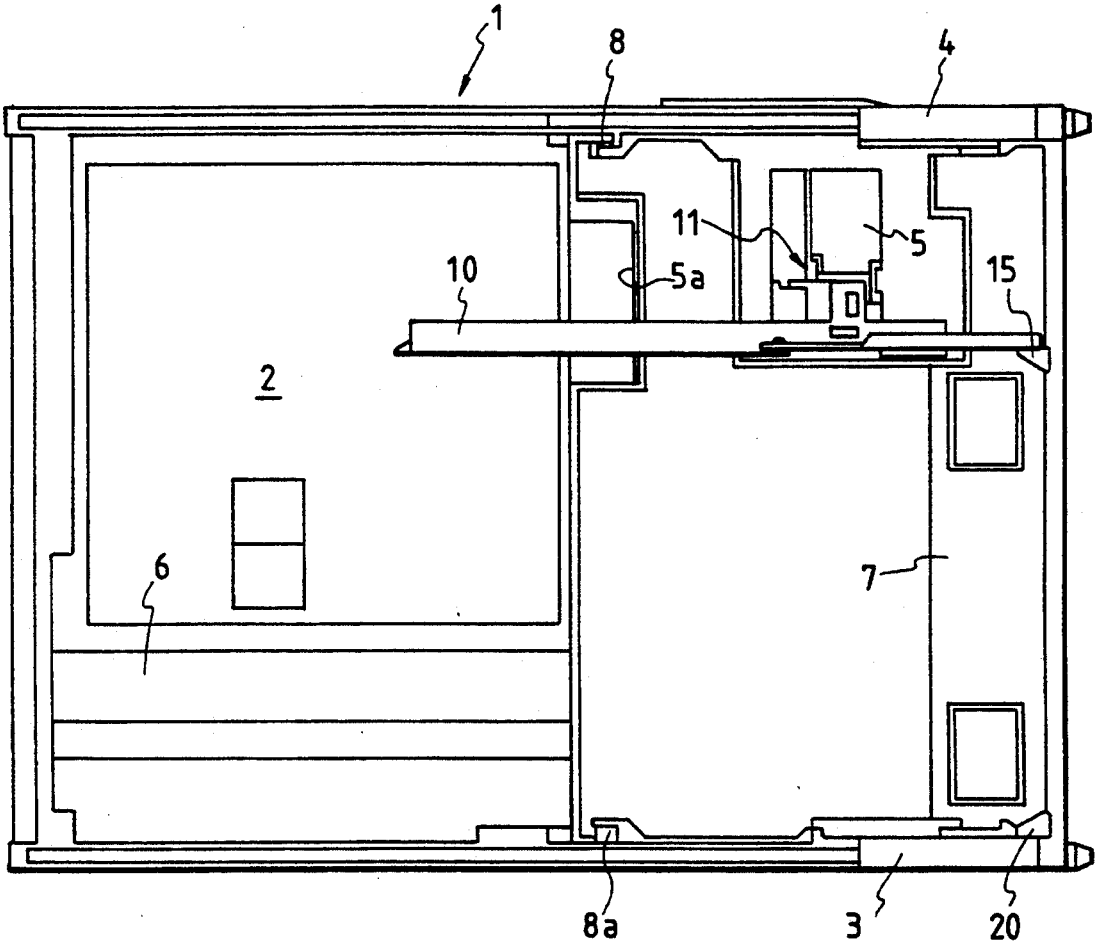
FIG. 4 is a plan view of the paper feeding cassette including the snubber mounted on the movable side guide and the snubber on the stationary side.
Figure 5:
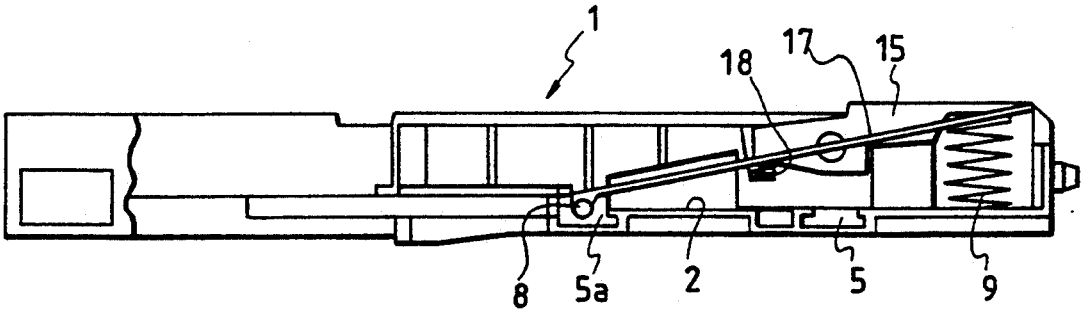
FIG. 5 is a side view of the paper feeding cassette shown in FIG. 4.

The aforementioned two kinds of snubbers can be employed for a paper feeding cassette 1 as shown in FIG. 4 and FIG. 5. The paper feeding cassette as shown in FIG. 4 is generally called an universal type cassette. Papers each having an arbitrary size can be received in a paper receiving section of the paper feeding cassette 1 in such a manner that the papers come in close contact with the inner wall surface of a side plate 3 along one side edge thereof while they are squeezed by the side guide 10 along the other side edge so that they assume a correct position in the paper feeding cassette 1. The paper feeding cassette 1 includes a turnable bottom plate 7 which is located at the fore end part of the paper delivery side, and its bottom plate 7 is turnably supported to turn about support points 8 and 8*a* on both the side plates of the paper feeding cassette 1.

As is best seen in FIG. 5, a spring 9 is arranged between the turnable bottom plate 7 and a bottom plate 2 of the paper feeding cassette 1 so that the foremost end of the bottom plate 7 is turnably displaced so as to allow the foremost end of each paper to be slantwise oriented in the upward direction. Thus, each paper can be delivered toward a paper feeding roller (not shown) with a constant magnitude of delivering force during a paper feeding operation while the bottom plate 7 is turnably displaced in the upward direction by the spring 9. The rear end part of each paper in the paper receiving section can be located by an end guide (not shown). For the purpose of simplification, illustration of the side guide is neglected but only a guide groove 6 is shown in FIG. 4.

The side guide 10 is movably mounted in the paper feeding cassette 1 to move from the other side plate 4 toward the opposite side plate 3 of the paper feeding cassette 1, and the guide grooves 5 and 5*a* are formed to serve as guiding means for the side guide 10 as described above with reference to FIG. 2. The snubber 20 is mounted on the side wall 3 of the paper feeding cassette 1, while the snubber 15 is mounted on the side guide 10. Thus, each paper to be delivered is positionally restricted by both the snubbers 15 and 20 at the opposite corners thereof on the delivery side of the paper feeding cassette 1. With this construction, both the snubbers 15 and 20 constitute paper disjointing means operable during a paper feeding operation. While the bottom plate 7 is normally turnably biased in the upward direction by the spring 9 as shown in FIG. 5, each paper is depressed at the opposite corners with a predetermined intensity of depressing force given by both the snubbers 15 and 20 so that it is delivered further by rotating the paper feeding roller.

When each paper is delivered from the paper feeding cassette 1, a feeding function is imparted to the uppermost paper from the paper feeding roller while the opposite corners of the paper are firmly depressed by the snubbers 15 and 20, whereby the paper to be delivered is forcibly deformed to assume the arched sectional contour. As a result, a certain force is caused by the arched sectional contour of the paper so as to allow both the snubbers 15 and 20 to be slightly raised up. Thus, the paper is disjointed from the paper located below the first-mentioned one as its both corner portions are disengaged from the pawl members, resulting in just one paper being delivered from the paper feeding cassette 1. At this time, each snubber is turnably displaced to turn about its support shaft, and as shown in FIG. 1, the spring 18 is compressed by the snubber 15. In other words, although the snubber 15 has a weight less than that of the snubber 20, the differential weight between the snubber 15 and the snubber 20 is compensated by the spring 18 so as to enable the snubber 15 to exhibit the same depressing force as that of the snubber 20.

As described above, according to the present invention, since the snubber having a light weight is biased by the spring, an uniform paper disjointing function can be exhibited by each of the two snubbers. It has been generally known that a snubber oscillates with an amplitude corresponding to its weight when papers are individually disjointed from each other. According to the present invention, however, since the snubber having a lighter weight is biased by the spring 18, both the snubbers 15 and 20 can oscillate with a same amplitude without such a malfunction that one corner portion of a paper moves ahead of the other corner portion of the same.

The present invention should not be limited only to the snubber on the movable side constructed in the accordance with the embodiment of the present invention as described above with reference to the accompanying drawings. Alternatively, the snubber on the movable side may be biased by another spring means corresponding to various structural conditions associated with case that it is unavoidably constructed in smaller dimensions or case that the depressing force given by the spring can not be held in the well-balanced state. The spring means disposed for the snubber on the movable side should not be limited only to a coil spring. Any type of spring member may be employed for the snubber on the movable side, provided that it is proven that the depressing force of a pawl member for one snubber is substantially equalized to that of a pawl member for the other snubber.

While the present invention has been described above with respect to a single preferred embodiment thereof, it should of course be understood that the present invention should not be limited only to this embodiment but various change or modification may be made without departure from the scope of the present invention as defined by the appended claims.

What is claimed is:

1. A paper disjointing device for a paper feeding unit wherein a plurality of papers received in said paper feeding unit are squeezed against a side wall of said paper feeding unit by a movable side guide slidably mounted on a bottom plate of said paper feeding unit in order to account for varying sizes of said plurality of papers, the paper disjointing device comprising:

a first snubber turnably mounted on said movable side guide and disposed to depress a corner of a single sheet of paper in the plurality of papers, said first snubber having a cutout portion to allow mobility and having a light weight due to the cutout portion, the first snubber being turnably biased to generate a first depressing force using a first pawl member disposed at a foremost end thereof;

a second snubber turnably mounted on said wall located opposite to said movable side guide and disposed to depress another corner of said single sheet of paper, said second snubber having a weight larger than that of said first snubber and being turnably supported to generate a second depressing force using a second pawl member disposed at a foremost end thereof; and means for increasing the first depressing force so that the first depressing force is substantially equal to the second depressing force.

2. The paper disjointing device according to claim 1, wherein the means for increasing the first depressing force includes a biasing means for biasing the foremost end of the first snubber.

3. The paper disjointing device according to claim 2, wherein the biasing means is a coil spring located behind a support shaft of the first snubber.

4. The paper disjointing device according to claim 3, wherein the coil spring is disposed between a rear end of the first snubber and a support anvil on the movable side guide.

* * * * *